United States Patent [19]

Sato et al.

[11] Patent Number: 4,465,952

[45] Date of Patent: Aug. 14, 1984

[54] SPARK PLUG FOR INTERNAL COMBUSTION ENGINES

[75] Inventors: Yasuyuki Sato, Kasugai; Norihiko Nakamura, Mishima; Tatsuo Kobayashi, Susono, all of Japan

[73] Assignees: Nippondenso Co., Ltd., Kariya; Toyota Jidosha Kogyo Kabushiki Kaisha, Toyota, both of Japan

[21] Appl. No.: 354,793

[22] Filed: Mar. 4, 1982

[30] Foreign Application Priority Data

Mar. 31, 1981 [JP] Japan ..... 56-49162

[51] Int. Cl.[3] ..... H01T 13/20

[52] U.S. Cl. ..... 313/136; 313/141; 313/142

[58] Field of Search ..... 313/136, 141, 142

[56] References Cited

U.S. PATENT DOCUMENTS

| | | | |
|---|---|---|---|
| 2,439,590 | 4/1948 | Tognola | 313/141 X |
| 3,868,530 | 2/1975 | Eaton et al. | 313/141 |
| 4,015,160 | 3/1977 | Lara et al. | 313/141 X |
| 4,122,366 | 10/1978 | von Stutterheim et al. | 313/141 |

FOREIGN PATENT DOCUMENTS

| | | | |
|---|---|---|---|
| 2404454 | 8/1975 | Fed. Rep. of Germany | 313/141 |

*Primary Examiner*—Eugene R. LaRoche
*Assistant Examiner*—Vincent DeLuca
*Attorney, Agent, or Firm*—Cushman, Darby & Cushman

[57] ABSTRACT

A spark plug for internal combustion engines has center and grounded electrodes having surfaces disposed adjacent to a spark gap between the electrodes and directed to but spaced from each other and also have side faces converging toward the spark gap. Each of the electrodes is provided with a piece of a noble metal secured to the surface directed to the other electrode. The noble metal pieces provided on both electrodes define the spark gap therebetween.

5 Claims, 6 Drawing Figures

SPARK PLUG FOR INTERNAL COMBUSTION ENGINES

BACKGROUND OF THE INVENTION

Field of the Invention

The present invention relates to a spark plug for internal combustion engines and, more particularly, to spark plug having an improved resistance to consumption or wear of the electrodes and an improved ignition performance.

The invention will be described in detail with reference to the accompanying drawings.

DESCRIPTION OF THE PRIOR ART

Figure 1:
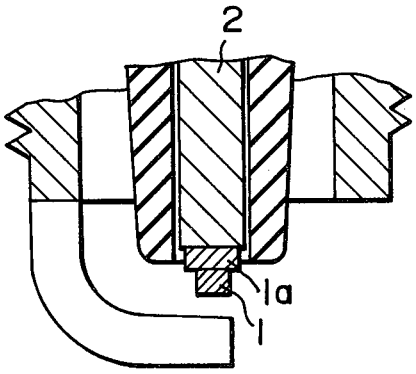
FIG. 1 PRIOR ART
FIG. 1 is an enlarged fragmentary sectional view of an example of the prior art spark plugs.

FIG. 1 shows a typical example of the conventional spark plugs intended to provide improved resistance to the electrode consumption and ignition performance. This spark plug has a center electrode 2 provided at its end with a tip 1 made of a noble metal. More specifically, the spark plug is provided with a disc-like base portion 1*a* attached to the end surface of the center electrode 2. The tip 1 of the noble metal is substantially cylindrical and fixed to the base portion 1*a*. Usually, the base portion 1*a* has a diameter of about 2.5 mm and an axial height or length of about 0.5 mm, while the tip end portion 1 has a diameter of about 1 mm and an axial height or length of about 1.5 mm.

This known spark plug is very expensive because the noble metal is used wastefully even at the portion of the plug which is not subjected to the consumption of the electrode.

Namely, in the spark plug shown in FIG. 1, it is necessary to form the base portion 1*a* for connecting the tip end portion 1 to the body of the center electrode 2. However, this base portion 1*a* does not contribute to the prevention of consumption of the electrode. If the entire part of the tip including the base portion 1*a* and the tip end portion 1 is made from platinum (Pt), the weight of the tip is as large as 0.08 g. The consumption of the tip metal after 30,000 mile-running is less than 0.01 g. It will be seen how wastefully the noble metal has been used in the prior art spark plug.

SUMMARY OF THE INVENTION

Accordingly, an object of the invention is to provide an improved spark plug for internal combustion engines, including a center electrode and a grounded electrode, said center and grounded electrodes having surfaces disposed adjacent to a spark gap between said electrodes and directed to but spaced from each other, wherein at least one of said electrodes has side faces converging to the surface of said one electrode directed to the other electrode and wherein at least said one electrode is provided with a piece of a noble metal secured to the surface of said one electrode directed to the other electrode.

The above and other objects, features and advantages of the invention will be made apparent by the following description with reference to the accompanying drawings.

DESCRIPTION OF PREFERRED EMBODIMENTS

Figure 2:
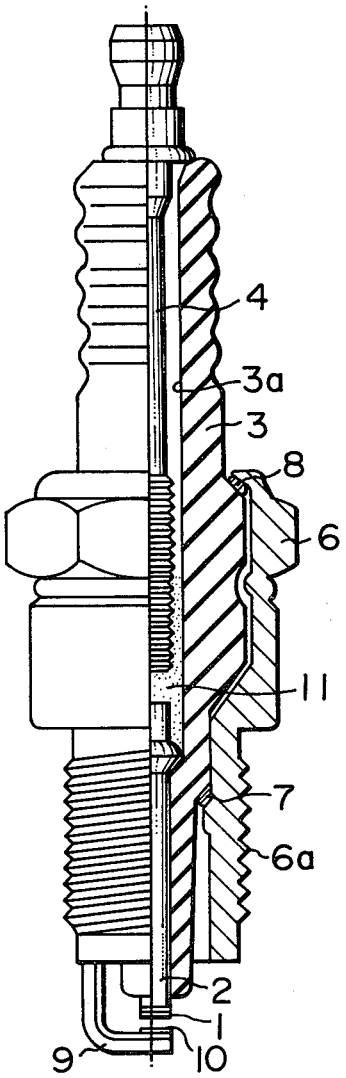
FIG. 2 is a partly sectional enlarged side elevation of an embodiment of the spark plug according to the present invention.
Figure 3:
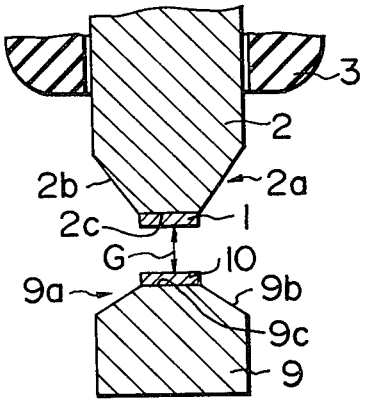
FIG. 3 is an enlarged fragmentary sectional view of the spark plug shown in FIG. 2 taken on line III—III in FIG. 3A.
Figure 3A:
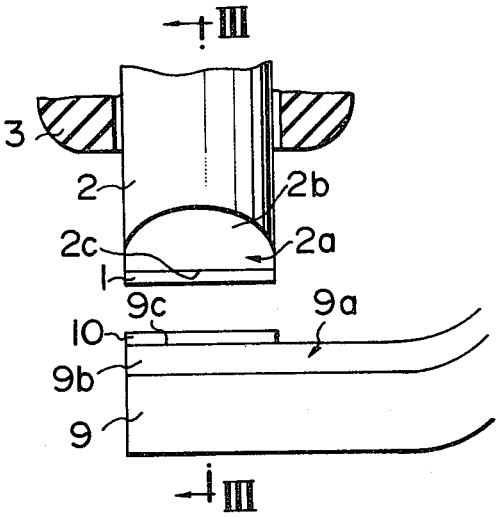
FIG. 3A is an enlarged fragmentary side elevational view of the spark plug taken from one side of FIG. 3.

Referring to FIGS. 2, 3 and 3A showing an embodiment of the spark plug according to the present invention, the spark plug includes a center electrode 2 made of a heat and corrosion resistant, electrically conductive base metal such as nickel (Ni), nickel-copper alloy (Ni-Cu) or the like. The forward end portion of the central electrode is gradually thinned toward the end extremity to provide a substantially trapezoidal section 2*a* taken in the plane containing the longitudinal axis of the center electrode 2. The center electrode 2 is received in a bore 3*a* formed in an insulator 3 made from an alumina porcelain and projects out of the forward end of the bore 3*a*. The bore 3*a* also receives in its upper portion an intermediate electrode shaft 4 made from a carbon steel. The spark plug further includes a cylindrical housing made from an electrically conductive base metal having high resistances to corrosion and heat. The insulator 3 is fixed to the inner surface of the housing 6 by an annular gas-tight packing 7 and a caulking ring 8 interposed therebetween. The lower portion of the housing 6 is provided with external screw threads 6*a* by means of which the spark plug is mounted and fixed to the cylinder block of an internal combustion engine. A grounded electrode 9 is also made from a heat and corrosion resistant electrically conductive base metal, such as nickel (Ni), and has a sparking end portion 9*a* which is gradually thinned toward the center electrode to provide a substantially trapezoidal section taken in the plane including the longitudinal axis of the center electrode 2. The grounded electrode 9 is fixed to the lower or forward end surface of the housing 6 by welding. The annular space surrounded by the wall of the bore 3*a* of the insulator 3 is filled with an electrically conductive glass seal layer 11 which provides an electric connection between the intermediate electrode shaft 4 and the center electrode 2 while mechanically fixing them to the wall of the bore 3*a*. The layer 11 is formed from a mixture of powdered copper and glass having a relatively low melting point.

The trapezoidal portion 2*a* of the center electrode 2 is so shaped as to provide a pair of forwardly converging side surfaces 2*b* disposed to extend in generally parallel relationship to converging side faces 9*b* of the trapezoidal portion 9*a* of the grounded electrode 9. A rectangular plate or piece 1 made of a noble metal, such as platinum (Pt), is fixed by resistance welding to an end surface 2*c* of the trapezoidal portion 2*a* of the center electrode 2. Similarly, a rectangular plate or piece 10 made of a noble metal, such as platinum (Pt), is fixed by resistance welding to the end surface 9*c* of the trapezoidal portion 9*a* of the grounded electrode 9. A sparking gap G is formed between the opposing surfaces of the rectangular pieces 1 and 10.

In operation, sparking takes place across the sparking gap G between the noble metal piece 1 fixed to the end surface 2*c* of the center electrode 2 and the noble metal piece 10 fixed to the end surface 9*c* of the grounded electrode 9. The air-fuel mixture fed into engine is therefore ignited by the spark. During operation of the engine, the noble metal pieces 1 and 10 are continuously subjected to combustion gases at high pressure and temperature. However, the consumption of the noble metal pieces 1 and 10 is of a very low rate because the noble metal has a high resistance to sparking consumption. In the U.S.A., there is a regulation which calls for 30,000-mile maintenance of each spark plug. This means that the spark plug should have a durability sufficient to withstand a long use for 30,000-mile running of an associated motor car. Such a durability can be ensured by 0.005 g only of a noble metal in terms of platinum (Pt), which amounts to one tenth (1/10) to one fifth (1/5) the amount of platinum used in the prior art spark plug shown in FIG. 1.

Thus, the spark plug of the invention makes quite an economical use of the noble metal and, accordingly, can be produced at a sufficiently low cost. This feature is quite advantageous from the view point of saving of natural resources which is now a serious matter of concern all over the world. In the spark plug of the described embodiment of the invention, moreover, the cross-sectional area of the spark-producing portion of each electrode is reduced to ensure a high ignition performance of the plug at a comparatively low voltage.

The feature of the described spark plug that the center and ground electrodes 2 and 9 are gradually thickened away from the spark gap G to provide gradually increasing cross-sections advantageously prevents the electrodes from being extensively corroded due to oxidation and residual combustion products, to thereby eliminate the prior art problem that the noble metal pieces are separated from the electrodes because the ends of the electrodes to which the noble metal pieces are attached are corroded during long use of the spark plug. In addition, the trapezoidal sectional shapes of the ends of electrodes provides an advantage that the spark gap G can conveniently be adjusted by placing a thickness gauge in the spark gap G and applying an impact force to the outer surface of the grounded electrode 9 without causing any buckling thereof which would otherwise be caused as in the prior art spark plug which utilized thin electrodes.

Figure 4:
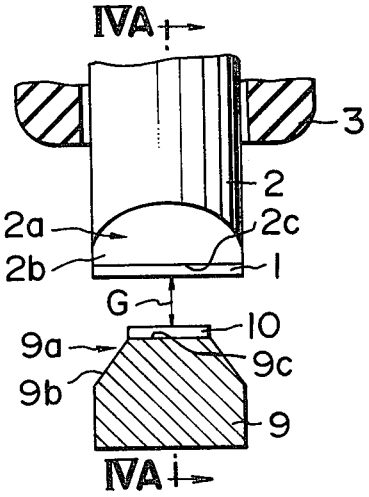
FIG. 4 is an enlarged partly sectional fragmentary view of another embodiment of the spark plug according to the present invention taken on line IV—IV in FIG. 4A.
Figure 4A:
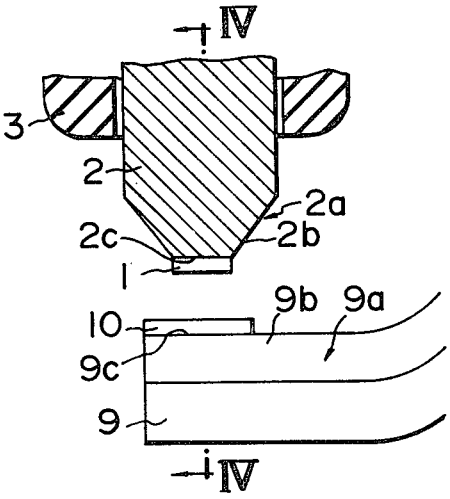
FIG. 4A is a partly sectional enlarged side view of the spark plug shown in FIG. 4 taken on line IVA—IVA in FIG. 4.

FIGS. 4 and 4A show another embodiment of the spark plug of the invention. In this embodiment, the trapezoidal portion 2*a* of the center electrode 2 is angularly offset substantially 90 degrees from the trapezoidal portion 9*a* of the grounded electrode 9.

In the described embodiments of the invention, the center and grounded electrodes 2 and 9 are both provided with the trapezoidal portions 2*a* and 9*a*. This, however, is not essential to the invention. In other words, the scope of the present invention covers an embodiment in which one of the two electrodes is provided with a trapezoidal spark-producing portion. In addition, the noble metal pieces may be formed from noble metals other than platium (Pt), such as palladium (Pd), iridium (Ir), gold (Au) or alloys of these metals.

The advantages of the invention may be summarized as follows:

(1) Since at least one of the center and grounded electrodes has a trapezoidal end portion connected with a piece of a noble metal, it is not necessary to use an unduly large amount of the noble metal as in the prior art spark plug. Thus, the amount of the noble metal used in the spark plug according to the present invention is considerably reduced as compared with the prior art spark plug, to thereby lower the cost of production of the spark plug.

(2) Since at least one of the center and grounded electrodes has a trapezoidal end portion, a space wider than the spark gap G is formed around the converging surface of the trapezoidal end portion of the one electrode. This wide space effectively promotes the growth and propagation of an initial ignition flame to ensure a high ignition performance of the spark plug.

(3) The trapezoidal end portion of the electrode provides a sufficient resistance to buckling of the electrode to eliminate the undesirable deformation of the electrode which would otherwise be caused as in the prior art spark plug when the electrode is struck to adjust the dimension of the spark plug.

What is claimed is:

1. A spark plug for internal combustion engines, including a center electrode and a grounded electrode, said center and grounded electrodes having surfaces disposed adjacent to a spark gap between said electrodes and directed to but spaced from each other, wherein at least one of said electrodes has substantially planar side faces converging to the surface of said one electrode directed to the other electrode and wherein at least said one electrode is provided with a piece of a noble metal secured to the surface of said one electrode directed to the other electrode.

2. A spark plug according to claim 1, wherein said center and grounded electrodes both have converging side faces and are both provided with pieces of noble metal.

3. A spark plug according to claim 2, wherein the converging side faces of said center electrode are substantially opposite to the converging side faces of said grounded electrodes.

4. A spark plug according to claim 2, wherein the converging side faces of said center electrode are angularly offset substantially 90 degrees from the converging side faces of said grounded electrode.

5. A spark plug according to any one of the preceding claims, in which said noble metal is selected from a group consisting of platinum, palladium, iridium, gold and their alloys.

* * * * *